US010173309B2

(12) United States Patent
Jaeger et al.

(10) Patent No.: US 10,173,309 B2
(45) Date of Patent: Jan. 8, 2019

(54) INTERFACE DEVICE FOR TENSIONING A NUT AND A BOLT ASSEMBLY

(71) Applicant: Hytorc Norge AS, Sola (NO)

(72) Inventors: Andreas Holst Jaeger, Stavanger (NO); Ruben Helmikstol, Jorpeland (NO)

(73) Assignee: Hytorc Norge AS, Sola (NO)

( * ) Notice: Subject to any disclaimer, the term of this patent is extended or adjusted under 35 U.S.C. 154(b) by 130 days.

(21) Appl. No.: 15/128,189

(22) PCT Filed: Feb. 26, 2015

(86) PCT No.: PCT/NO2015/050043

§ 371 (c)(1),
(2) Date: Sep. 22, 2016

(87) PCT Pub. No.: WO2015/152728

PCT Pub. Date: Oct. 8, 2015

(65) Prior Publication Data

US 2017/0095915 A1 Apr. 6, 2017

(30) Foreign Application Priority Data

Apr. 4, 2014 (NO) ..... 20140440

(51) Int. Cl.
*B25B 29/02* (2006.01)
*B25B 13/06* (2006.01)

(52) U.S. Cl.
CPC ..... *B25B 29/02* (2013.01); *B25B 13/06* (2013.01)

(58) Field of Classification Search
CPC ..... B25B 29/02; B25B 13/488
USPC ..... 81/57.38
See application file for complete search history.

(56) References Cited

U.S. PATENT DOCUMENTS 5,123,308 A * 6/1992 Shaffer ..... B25B 17/02 81/56
5,253,967 A * 10/1993 Orban ..... F16B 33/00 29/525.11
5,318,397 A 6/1994 Junkers
5,341,560 A 8/1994 Junkers
(Continued)

FOREIGN PATENT DOCUMENTS

WO 9429080 A1 12/1994

OTHER PUBLICATIONS

Hytorc Nut—mekanisk strekker, Dec. 19, 2012 http://web.archive.org/web/20121219144229/http://www.hytorc.no/hytorc-nut/.

*Primary Examiner* — Hadi Shakeri
(74) *Attorney, Agent, or Firm* — Gable Gotwals

(57) ABSTRACT

An interface device for tensioning or relaxing a bolt in a nut-and-bolt assembly wherein the bolt extends in an axial direction. The interface device comprises a frame having a first end portion and a second end portion. The first end portion is provided with a rotatably-mounted nut ring for receiving and rotating a conventional nut on the bolt. The second end portion comprises a mechanical tensioner nut configured for reacting on the frame and for receiving a part of the bolt that extends beyond the conventional nut. The mechanical tensioner nut is configured for being driven by a low-pressure torque tension tool to tension or relax the bolt in operational use of the interface device. The device provides a very compact torqueing solution for use with low-pressure torqueing tools.

5 Claims, 4 Drawing Sheets

(56) References Cited

U.S. PATENT DOCUMENTS

| | | | | |
|---|---|---|---|---|
| 5,406,867 | A * | 4/1995 | Junkers | B25B 29/02<br>81/57.38 |
| 5,538,379 | A | 7/1996 | Junkers | |
| 5,946,789 | A | 9/1999 | Junkers | |
| 6,490,952 | B2 | 12/2002 | Junkers | |
| 6,810,571 | B1 * | 11/2004 | Junkers | B25B 13/488<br>29/446 |

* cited by examiner

INTERFACE DEVICE FOR TENSIONING A NUT AND A BOLT ASSEMBLY

CROSS-REFERENCE TO RELATED APPLICATION

This United States National Phase of PCT Application No. PCT/NO 2015/050043 filed 26 Feb. 2015, claims priority to Norwegian Patent Application No. 20140440 filed 4 Apr. 2014, each of which are incorporated herein by reference.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable.

BACKGROUND OF THE INVENTION

The invention relates to an interface device for tensioning or relaxing a bolt in a nut-and-bolt assembly.

Hydraulic bolt tensioning exits already for many years. In the prior art a hydraulic bolt tensioning tool has been reported which provides a quick and easy method for tightening large diameter bolts to high and accurate pre-loads. Unlike earlier methods it does not use torque and does not require any forceful turning of the nut or bolt, like impact wrenches, flogging spanners or hydraulic torque wrenches. All of the older methods have one common problem, namely friction. Overcoming thread friction and friction between the nut and the washer uses up over 80% of the torque energy applied to the nut or bolt, leaving less than 20% of the energy to produce useful tension in the shank of the bolt. Variations in this friction loss, from bolt to bolt causes non-uniform tension in bolts that have been tightened to the same torque or impact wrench setting.

The known hydraulic bolt tensioner, such as the Boltight™ hydraulic bolt tensioner, is an annular jack, which fits over the bolt and nut to be tightened. The jack pushes against the bolted joint and pulls on the end of the bolt, which needs to be at least one diameter longer to accommodate the bolt-tensioning tool. Because the force produced, by the jack, is applied directly to the end of the bolt, a tension equal to the load generated by the jack is developed in the shank of the bolt. With the jack applying the tension, it is possible to turn the nut with zero torque until it is tight. The load applied by the jack is then relaxed and a high percentage, depending on the length of the bolt and its diameter, is retained in the shank of the bolt. Bolt tensioning tools can be ganged together to enable multiple bolts to be tightened simultaneously, to the same high and accurate pre-load. This is particularly useful when compressing gaskets in pipeline or pressure vessel flanged connections. The high load developed by the multiple bolt tensioning tools, is evenly distributed around the join causing the gasket to flow into the surface irregularities of the flange giving a much better seal.

Flexible hoses with self-sealing quick connect couplings are used to gang the bolt tensioning tools together to form a hydraulic ring main. The ring main and tensioning tools are normally pressurised using an air driven pump working from a compressed air supply.

A severe disadvantage of the known hydraulic tensioner is that the required diameter of the hydraulic cylinder in the jack is directly proportional to the required tension in the shank of the bolt at a given pressure of the hydraulic cylinder. So, at a given pressure in the cylinder, a larger required tension means a larger diameter of the jack in order to produce the required force.

In certain applications, like the pipeline or pressure vessel flanged connections, such space may not always be available.

BRIEF SUMMARY OF THE INVENTION

The invention has for its object to remedy or to reduce at least one of the drawbacks of the prior art, or at least provide a useful alternative to prior art.

The invention is defined by the independent claims. The dependent claims define advantageous embodiments.

The object is achieved through features, which are specified in the description below and in the claims that follow.

In a first aspect the invention relates to an interface device for tensioning or relaxing a bolt in a nut-and-bolt assembly. The bolt extends in an axial direction. The interface device comprises a frame having a first end portion and a second end portion, opposite to the first end portion. The first end portion of the frame being provided with a rotatably mounted nut ring for receiving and rotating a conventional nut provided on the bolt in operational use of the interface device. The second end portion of the frame comprising a mechanical tensioner nut being configured for reacting on the frame and for receiving a part of the bolt that extends beyond the conventional nut in operational use of the interface device. The mechanical tensioner nut is further configured for being driven by a low-pressure torque tension tool to tension or relax the bolt in operational use of the interface device.

The effects of the combination of the features of the invention are as follows. Instead of using a hydraulic cylinder to set the tension in the shank of the bolt, the interface device of the invention uses a relatively mechanical small device namely the mechanical tensioner nut, which in the prior art is used as a replacement for conventional nuts. Moreover, such mechanical device may be torqued using conventional low pressure (and thus compact) tension tools. In this way the invention provides for a very compact torqueing solution, contrary to the prior art solution with the hydraulic cylinder.

For a proper understanding of the scope of the invention a few expressions and terms are further defined in this paragraph. In the context of the invention with the term "low-pressure torque tension tool" is typically meant an air-pressure tension tool, which operates at pressures in the range from 2 bar to 20 bar, and preferably between 5 and 6 bar.

In the context of the invention the terms "bolt" and "stud" are supposed to mean the same. Such terms may be used interchangeably. In the context of the invention with the term "mechanical tensioner nut" is typically meant a special non-conventional nut which enables a torque free tensioning by converting a rotational movement into a translational movement. Various types and variations of the mechanical tensioner nuts have been reported in the prior art, for instance in U.S. Pat. Nos. 5,318,397, 5,341,560, 5,538,379, 5,946,789, 6,490,952Bw. All these documents are herewith incorporated by reference in their entirety. in general the mechanical tensioner nut relies upon converting a rotating movement around a thread on a bolt into a translation of said bolt, thereby tensioning or relaxing the bolt. A commercially available mechanical tensioner nut is the Hytorc Nut ™ .

An embodiment of the interface device according to the invention further comprises a pressure measure device in between the mechanical tensioner nut and the frame for measuring a reaction force of the mechanical tensioner nut on the frame as an indication of a tension in a shank of the bolt. Adding a pressure measure device between the mechanical tensioner nut and the frame results in a tool, with which the tension in the shank of the bolt can be bolt can be conveniently set to a predetermined value. In the context of the invention it must be understood that "the predetermined value of the tension" may also be denoted as the "pre-load on the bolt".

In an embodiment of the interface device according to the invention the mechanical tensioner nut comprises a first part connectable with said bolt to pull said bolt in the axial direction for elongating said bolt and thereby for tensioning said bolt, or to relax said bolt by shortening said bolt. Said mechanical tensioner nut further comprises a second part connected with said first part, and a friction element configured for cooperating with at least one of said parts. Said second part is freely rotatable relative to said friction element while it freely abuts against said friction element. Said first part has a threaded outer surface and said second part has a threaded inner surface for cooperating with said threaded outer surface of said first part, so that, when the second part is rotated in a transverse direction around a virtual axis that extends in an axial direction of the mechanical tensioner nut, said first part moves only in the axial direction so as to tension or relax said bolt, wherein the direction into which said first part moves depends on the rotational direction of the second part. The embodiment here described provides an advantageous embodiment of the mechanical tensioner nut, wherein a torque free tensioning is enabled by converting a rotational movement (namely of the second part) into a translational movement (of the first part).

BRIEF DESCRIPTION OF THE DRAWINGS

In the following is described an example of a preferred embodiment illustrated in the accompanying drawings, wherein.

DETAILED DESCRIPTION OF THE PREFERRED EMBODIMENT

Figure 1:
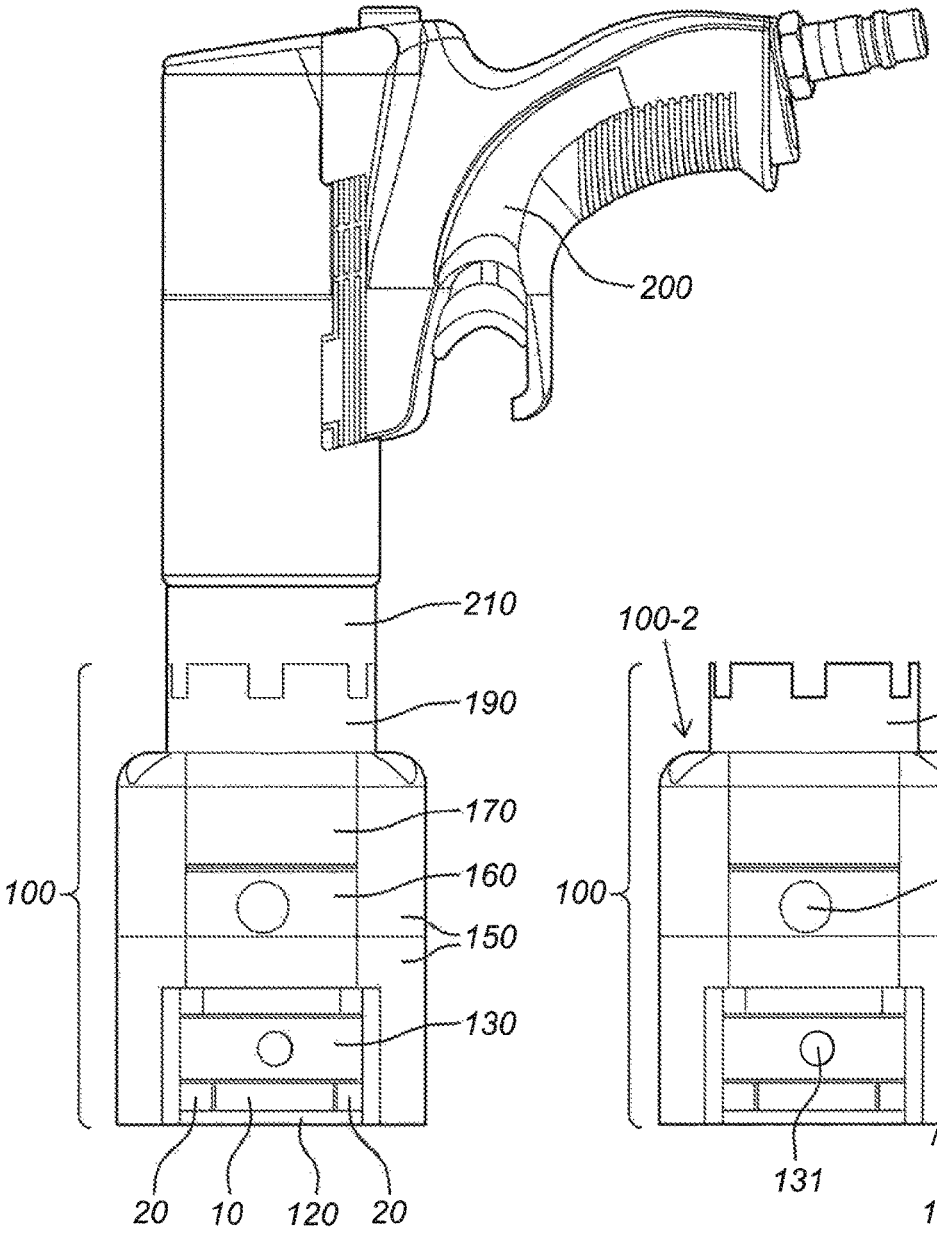
FIG. 1 shows an interface device in accordance with an embodiment of the invention in combination with a low-pressure tension tool coupled therewith.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage. Throughout the Figures, similar or corresponding features are indicated by same reference numerals or labels.

Figure 2:
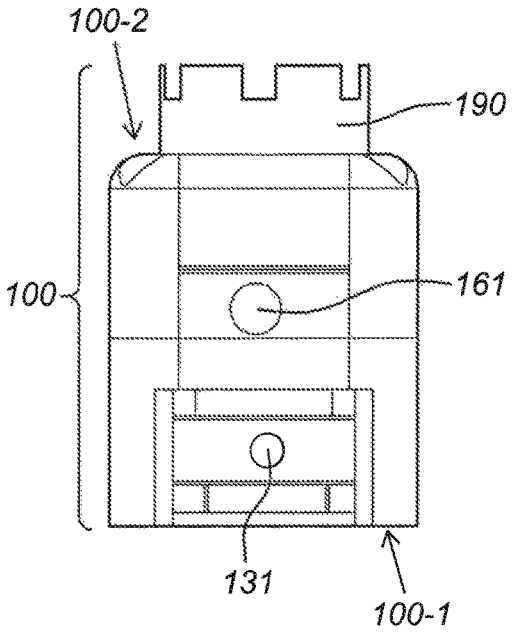
FIG. 2 shows the interface device of FIG. 1 without the tension tool.

FIG. 1 shows an interface device 100 in accordance with an embodiment of the invention in combination with a low-pressure tension tool 200 coupled therewith. FIG. 2 shows the interface device of FIG. 1 without the tension tool. The figures show the interface device 100 when coupled with a conventional pneumatic low-pressure tension tool 200, for instance operating at 5 bar. The interface device 100 is designed for receiving a bolt 10 and nut 20 assembly. The interface device 100 comprises a frame 150. At a first end portion 100-1 of the frame 150 there is provided a rotatably-mounted nut ring 130 for receiving the nut 20 of the bolt 10 and nut 20 assembly. The bolt 10 extends through the nut 20 and beyond the nut 20 within the frame 150.

In operational use of the interface device 100 the nut is secured with a ring 120 at the first end portion 100-1. The frame 150 further comprises a mechanical tensioner nut 190 at a second end portion 100-2 opposite to the first end portion 100-1. The mechanical tensioner nut 190 is provided within a housing 170, which forms part of the frame 150. In between the mechanical tensioner nut 190 and the frame 150 there is provided a pressure measure device 160, i.e. a commercially available load washer. This configuration results in the property that the reaction force applied by the mechanical tensioner 190 to the frame 150 is directly measured by the pressure measure device 160. In other words, the preload on the bolt can be precisely set. The pressure measure device 160 may also be dispensed with in other embodiments of the invention.

Figure 7:
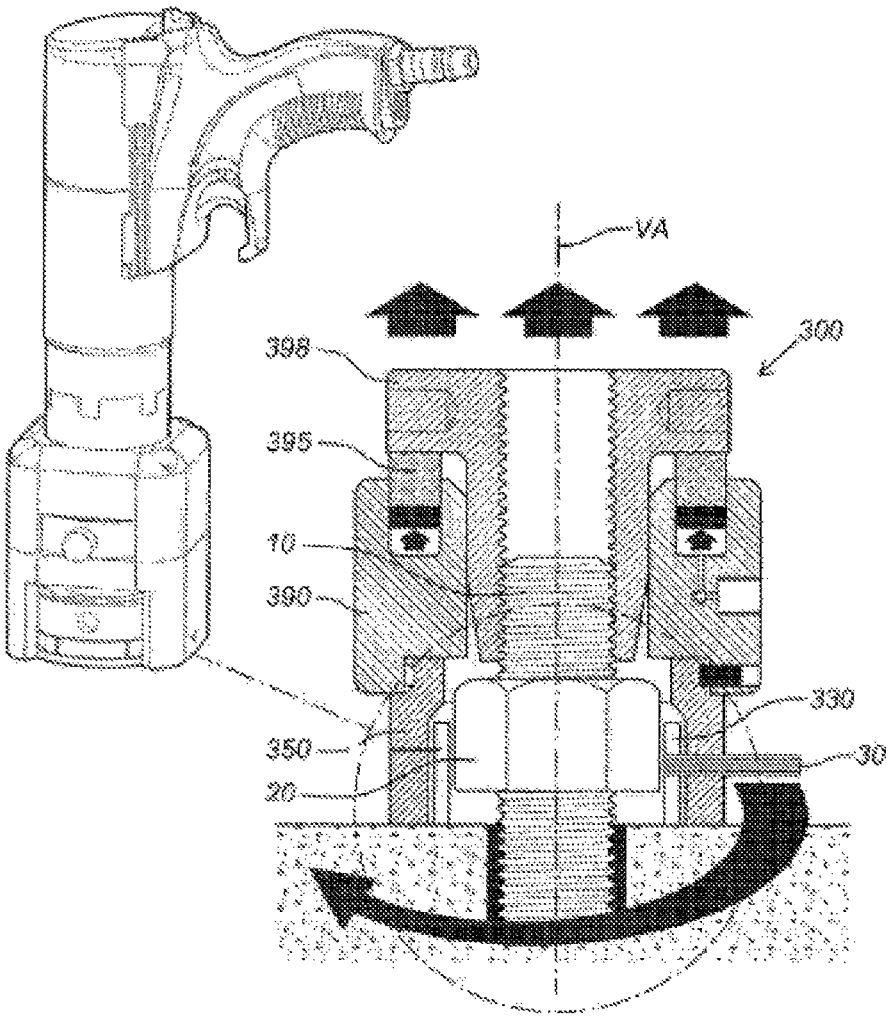
Fig. 7 (Prior Art)
FIG. 7 shows the assembly of FIG. 1 next to a prior art hydraulic bolt tensioner to illustrate the principle of torque-free bolt tensioning.

The rotatably-mounted nut ring 130 is provided with at least one hole 131 for receiving a torque bar (not shown in FIG. 1, but with reference number 30 in FIG. 7). The pressure measure device 160 is provided with a connector 161 for connecting the pressure measure device 160 to a read-out device (not shown). The conventional tool 200 is provided with an interface connector 210 for coupling with the mechanical tensioner nut 190.

FIG. 1 shows an embodiment, wherein a commercially available mechanical tensioner nut 190 has been incorporated in the interface device 100. It is important to note that in the embodiment of FIG. 1 the mechanical tensioner nut 190 is used for a different purpose than it was originally designed for, namely to pull the bolt 10 using the frame 150 as a reaction member, instead of simply replacing a conventional nut. It must be noted that this special way of using the mechanical tensioner nut 190 for a different purpose opens up the possibility to use conventional low-pressure pneumatic tension tool 200. Expressed differently, the tool no longer needs to approach the bolt 10 and nut 20 assembly from the side, but may approach it from the axial direction of the bolt 10.

This renders the interfacing between the bolt 10 and 20 assembly and the pneumatic tension tool 200 much easier. Obviously, it is also possible to integrate a comparably mechanical structure with a similar operation principle into the interface device 200, i.e. so not as an off-the-shelve component.

Figure 3:
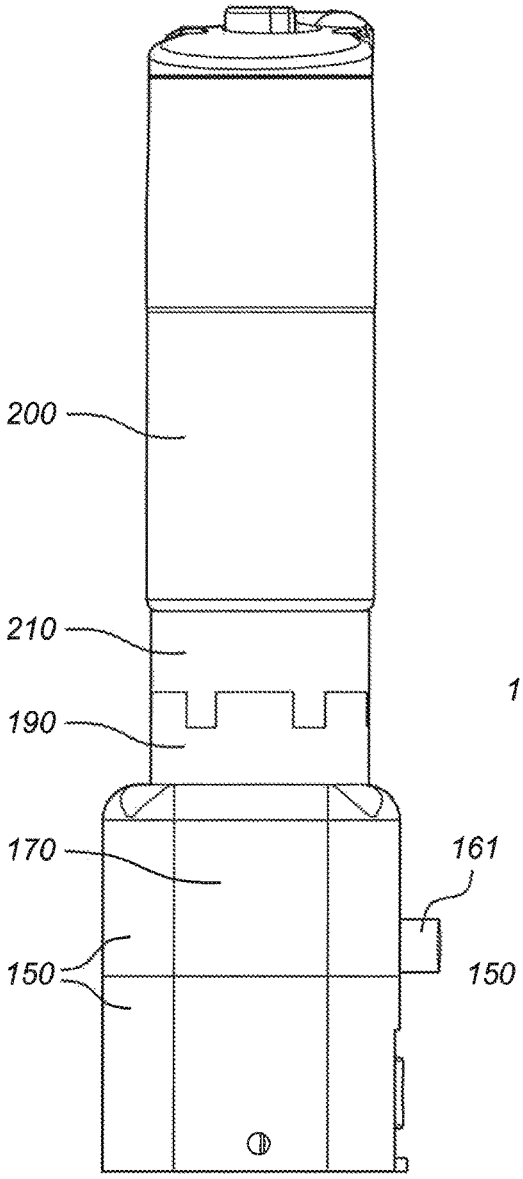
FIG. 3 shows the assembly of FIG. 1, when viewed from a different perspective.
Figure 4:
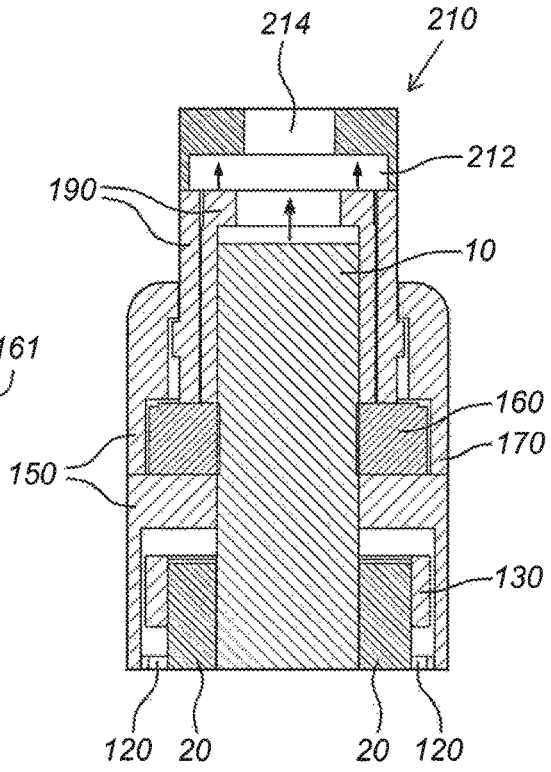
FIG. 4 shows part of a cross-sectional view of FIG. 3, while cutting through the dashed line, while the interface device is operationally used to tension a nut and bolt assembly.

FIG. 3 shows the assembly of FIG. 1 when viewed from a different perspective. FIG. 4 shows part of a cross-sectional view of FIG. 3, while cutting through the dashed line, while the interface device is operationally used to tension a nut 10 and bolt 20 assembly. It must be noted that the nut 10 and bolt 20 have been drawn in a simplified manner, i.e, without inner or outer threads. These figures will only be discussed in as far as they differ from the other figures or in as far as they illustrate further principles or aspects of the invention. FIG. 4 clearly illustrates how the mechanical tensioner nut 190 is provided with the housing 170 that is part of the frame 150, and how the bolt 10 and nut 20 are received within the interface device 100. FIG. 4 also illustrates the pressure measure device 160 provided in between the mechanical tensioner nut 190 and the frame 150. FIG. 4 further illustrates aspects of the interface connector 210 of the tension tool 200. The interface connector 210 matches the interface of the mechanical tensioner nut 190. Within the interface connector 210 there is provided a space 212 for receiving the inner part of the mechanical tensioner nut 190 when it moves up in the direction of the arrows during tensioning of the bolt 10. The interface connector 210 further comprises a connector opening 214 for coupling with the tension tool 200.

Figure 5:
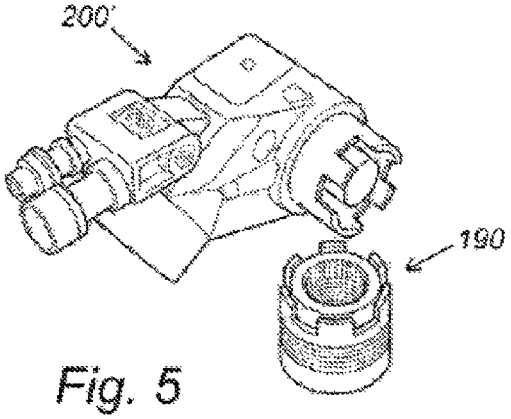
Fig. 5 (Prior Art)
FIG. 5 shows a commercially available tension tool designed for tensioning a mechanical tensioner nut.

FIG. 5 shows a commercially available tension tool 200' designed for tensioning a mechanical tensioner nut 190. The figure shows a space saving configuration, which may be important in the application field of compressing gaskets in pipeline or pressure vessel flanged connections, where typically a lot of bolts are provided around the circumference of the flange. It must be noted that also other dedicated tension tools 200' exist which would allow the bolt 10 to extend through it.

Figure 6:
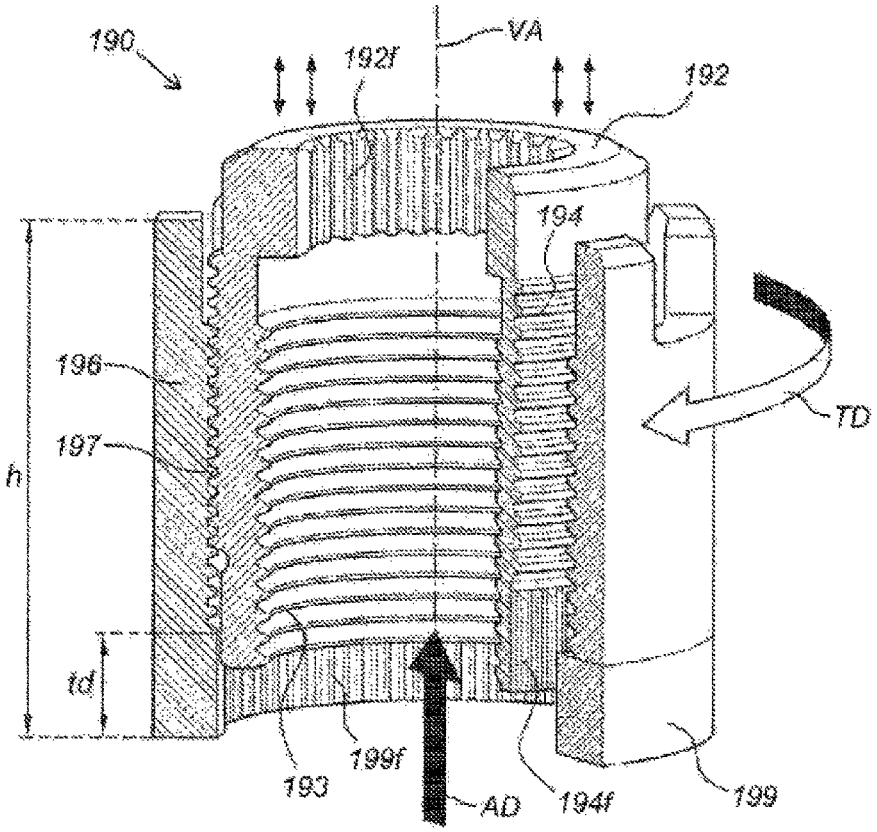
Fig. 6 (Prior Art)
FIG. 6 shows a perspective view of a commercially available mechanical tensioner nut with a cut out, which may be used in an embodiment of the invention.

FIG. 6 shows a perspective view of a commercially available mechanical tensioner nut 190 with a cut out, which may be used in an embodiment of the invention. It must be stressed that the implementation of FIG. 6 is one of the many possible implementations. Reference is made to the earlier mentioned documents U.S. Pat. Nos. 5,318,397, 5,341,560, 5,538,379, 5,946,789, 6,490,952B2, which are all incorporated by reference in their entirety. The mechanical tensioner nut 190 comprises a first part 192, which is configured for receiving the bolt (not shown) via an inner thread 193 that matches the thread of the bolt. The mechanical tensioner nut 190 further comprises a second part 196 that receives, cooperates with and is rotatable with respect to the first part 192. The mechanical tensioner nut 190 further comprises a friction element (such as a washer). Said second part 196 is freely rotatable relative to said friction element 199 while freely abutting against said friction element 199, said first part 192 having a threaded outer surface 194 and said second part 196 having a threaded inner surface 197 for cooperating with said threaded outer surface 194 of said first part 192.

In order to improve the functioning of the mechanical tensioner nut 190, both the first part 192 may be provided with friction outer surface 194*f* and the friction element 199 may be provided with a friction inner surface 199*f* as illustrated in FIG. 6. These respective friction surfaces 194*f*,199*f* are configured (for instance by longitudinal ridges) such that they allow for axial relative movement between the first part 192 and the friction element 199, while at the same time preventing or at least counteracting relative rotational movement between the first part 192 and the friction element 199. Similarly and for a similar purpose, the first part 192 may be provided with similar with a friction inner surface 192*f* as illustrated in FIG. 6. It can be seen from FIG. 6 that a maximum travel distance td, while still ensuring high friction between the first part 192 and the friction element 199, is determined by the height of the friction element 199 and is smaller than a height h of the mechanical tensioner nut 190.

Thus, the mechanical tensioner nut 190 (also referred to as a TN Series Clamp) is composed of at least three components: an inner sleeve (first part), an outer sleeve (second part) and a friction element (washer). As the outer sleeve turns in the transverse direction TD of the curved arrow the inner sleeve moves upwards in the axial direction AD of the straight arrow. The washer spline rotationally couples the inner sleeve with the washer preventing the inner sleeve from turning while providing a solid reaction point for turning the outer sleeve. For definition purposes the axial direction of the mechanical tensioner nut 190 has been illustrated in FIG. 6.

FIG. 7 shows the assembly of FIG. 1 next to a prior art hydraulic bolt tensioner to illustrate the principle of torque-free bolt tensioning. The prior hydraulic bolt tensioner 300 is shown on the right side of the figure. Important elements of this bolt tensioner 300 are the bridge 350, the puller 398 for receiving an end of the bolt 10 and the hydraulic cylinder 390 provided in between these elements and being configured to push the puller 398 up via an actuating ring 395. When the puller 398 is pushed up by the hydraulic cylinder 390 the nut 20 is effectively released from the surface and may be rotated in a torque free manner by rotating a rotatably-mounted nut ring 330 in which the nut 20 is received. The final preload setting of the nut 20 can be done by sticking a torque bar 30 into a hole of the nut ring 330 and applying a certain torque thereto such that the nut 20 properly pushes onto the surface. From FIG. 7 it can be learned that at least the following elements are effectively replaced by the mechanical tensioner nut of the invention: the hydraulic cylinder 390, the actuating ring 395 and the puller 398.

Also with reference to FIG. 7, the operational use of the interface device of the invention is as follows. First, a conventional nut is provided on the bolt. Then, the interface device is provided on the bolt. While doing so the inner part of the mechanical tensioner nut is screwed on the part extending beyond the conventional nut. Subsequently, a low-pressure torque tension tool is coupled to the interface and pressure is applied thereto (the mechanical tensioner nut will create a tension in the bolt). The conventional bolt is screwed until it makes contact with the surface (a flange for instance). No significant torque is required while doing so, but the torque bar 30 may be used for the final setting. As a next step, the pressure is released from the tension tool, and finally the interface device is decoupled and removed from the bolt.

The invention is not necessarily limited to the commercially available mechanical tensioner nut. Yet it may be seen as an advantage of the invention that such devices may be used to build the invention. The invention may be applied in any technical field, where conventional nuts can be replaced with mechanical tensioner nuts.

The invention claimed is:

1. Interface device (100) for tensioning or relaxing a bolt (10) in a nut-and-bolt assembly (10,20), wherein the bolt (10) extends in an axial direction, wherein the interface device (100) comprises:

a frame (150) having a first end portion (100-1) and a second end portion (100-2), opposite to the first end portion (100-1), the first end portion (100-1) of the frame (150) being provided with a rotatably-mounted nut ring (130) for receiving and rotating a conventional nut (20) provided on the bolt (10) in operational use of the interface device (100), the second end portion (100-2) of the frame (150) comprising a gearless mechanical tensioner nut (190) being configured for reacting on the frame (150) and for receiving a part of the bolt (10) that extends beyond the conventional nut (20) in operational use of the interface device (100), the gearless mechanical tensioner nut (190) being further configured for being driven by a low-pressure torque tension tool (200) to tension or relax the bolt (10) in operational use of the interface device (100); and the gearless mechanical tensioner nut (190) comprises a first part (192) connectable with said bolt (10) to pull said bolt (10) in the axial direction for elongating said bolt (10) and thereby for tensioning said bolt or to relax said bolt by shortening said bolt wherein said gearless mechanical tensioner nut (190) further comprises a second part (196) connected with said first part (192), and a friction element (199) configured for cooperating with at least one of said parts (192, 196), said second part (196) being freely rotatable relative to said friction element (199) while freely abutting against said friction element (199), said first part (192) having a threaded outer surface (194) and said second part (196) having a threaded inner surface (197) for cooperating with said threaded outer surface (194) of said first part (192), so that when the second part (196) is rotated in a transverse direction (TD) around a virtual axis (VA) that extends in an axial direction (AD) of the gearless mechanical tensioner nut (190), said first part (192) moves only in the axial direction (AD) so as to tension or relax said bolt (10), wherein the direction into which said first part (192) moves depends on the rotational direction of the second part (196).

2. The interface device (100) as claimed in claim 1, wherein the interface device (100) further comprises a pressure measure device (160) in between the gearless mechanical tensioner nut (190) and the frame (150) for measuring a reaction force of the mechanical tensioner nut (190) on the frame (150) as an indication of a tension in a shank of the bolt (10).

3. Interface device (100) for tensioning or relaxing a bolt (10) in a nut-and-bolt assembly (10,20), wherein the bolt extends in an axial direction, the interface device comprising:

a frame (150) including a first end portion (100-1) and a second end portion (100-2), the first end portion containing a rotatably mounted nut ring (130), the second end portion including a housing (170); and a mechanical tensioner nut ( 190) contained by the housing; the mechanical tensioner nut configured to push against the frame as a reaction member when tensioning the bolt; and the mechanical tensioner nut including an inner sleeve (192) configured for movement in the axial direction, the inner sleeve comprising an inner thread (193) and a friction outer surface (**194*f*) located below the inner thread, an outer sleeve (196) configured for movement in a transverse direction, the outer sleeve at least partially housing and in contact with the inner sleeve, the outer sleeve comprising an outer thread (197), a washer (199) including a friction inner surface (199*f***), the washer located below and in contact with the outer sleeve, the outer sleeve freely rotatable relative to the washer, wherein, when tensioning or relaxing the bolt, at least a portion of the friction inner and outer surfaces remain coupled to one another throughout movement of the inner sleeve in the axial direction, thereby preventing movement of the inner sleeve in the transverse direction and providing a reaction point for turning the outer sleeve.

4. The interface device as claimed in claim 3, the interface device further comprising a pressure measure device (160) in between the mechanical tensioner nut and the frame for measuring a reaction force of the mechanical tensioner nut on the frame as an indication of a tension in a shank of the bolt.

5. The interface device as claimed in claim 3, further comprising the friction inner and outer surfaces including longitudinal ridges.

* * * * *